US006051127A

United States Patent [19]

Moureaux

[11] Patent Number: 6,051,127

[45] Date of Patent: Apr. 18, 2000

[54] PROCESS FOR THE PREPARATION OF LUBRICATING BASE OILS

[75] Inventor: Patrick Moureaux, Grand Couronne, France

[73] Assignee: Shell Oil Company, Houston, Tex.

[21] Appl. No.: 08/886,726

[22] Filed: Jul. 1, 1997

[30] Foreign Application Priority Data

Jul. 5, 1996 [EP] European Pat. Off. ..... 96401486

[51] Int. Cl.[7] ..... C10G 47/00; C10G 69/02

[52] U.S. Cl. ..... 208/58; 208/59; 208/60; 208/138

[58] Field of Search ..... 208/138, 58, 59, 208/60

[56] References Cited

U.S. PATENT DOCUMENTS

| | | | |
|---|---|---|---|
| 2,779,713 | 1/1957 | Cole et al. . | |
| 3,459,656 | 8/1969 | Rausch . | |
| 4,574,043 | 3/1986 | Chester et al. | 208/59 |
| 4,747,932 | 5/1988 | Miller . | |
| 5,246,568 | 9/1993 | Forbus et al. | 208/59 |

FOREIGN PATENT DOCUMENTS

| | | |
|---|---|---|
| 373740 | 6/1990 | European Pat. Off. . |
| 1310320 | 3/1973 | United Kingdom . |
| 93/05125 | 3/1993 | WIPO . |

OTHER PUBLICATIONS

EPC Search Report dated Oct. 15, 1997.

*Primary Examiner*—Walter D. Griffin
*Assistant Examiner*—Tam M. Nguyen
*Attorney, Agent, or Firm*—Kim Muller

[57] ABSTRACT

Process for the preparation of lubricating base oils comprising the steps of (a) contacting a hydrocarbon oil feed in the presence of hydrogen in a first reaction zone with a catalyst comprising at least one Group VIB metal component and at least one non-noble Group VIII metal component supported on a refractory oxide carrier;

(b) separating the effluent at elevated pressure into a gaseous fraction and a liquid fraction having a sulphur content of less than 1000 ppmw and a nitrogen content of less than 50 ppmw;

(c) contacting the liquid fraction in the presence of hydrogen in a second reaction zone with at least a catalyst comprising a noble metal component supported on an amorphous refractory oxide carrier; and (d) recovering a lubricating base oil having a viscosity index of at least 80.

15 Claims, 1 Drawing Sheet

PROCESS FOR THE PREPARATION OF LUBRICATING BASE OILS

FIELD OF THE INVENTION

The present invention relates to a process for producing lubricating base oils. More specifically, the present invention relates to a process for producing lubricating base oils having a viscosity index of at least 80 by a multistage hydrocatalytic process involving a relatively severe first hydroconversion stage followed by one or more hydroconversion stages in which a noble metal-based catalyst is used.

BACKGROUND OF THE INVENTION

Multi-stage hydrocatalytic processes for preparing lubricating base oils are known in the art. Examples of such processes are disclosed in British Patent Specification No. 1,546,504, European Patent Specification No. 0,321,298 and U.S. Pat. Nos. 3,494,854 and 3,974,060. From these disclosures it becomes apparent that the first stage of a two stage hydroconversion process is usually aimed at removing nitrogen- and sulphur-containing compounds present in the hydrocarbon oil feed and to hydrogenate the aromatic compounds present in the feed to at least some extent. In the second stage the aromatics content is subsequently further reduced by hydrogenation and/or hydrocracking, whilst hydroisomerization of waxy molecules present in the first stage effluent often takes place as well. The hydrotreatment catalysts used in first and second stage should accordingly be able to adequately serve their respective purposes. From the aforementioned prior art documents it becomes clear that first stage catalysts normally comprise a Group VIII non-noble metal component and a Group VIB metal component on a refractory oxide support. First stage catalysts generally applied, then, include nickel-molybdenum, nickel-tungsten or cobalt-molybdenum on an alumina, silica-alumina or fluorided alumina support.

The patent specifications listed above disclose a variety of suitable second stage catalysts and process conditions to be applied in the second stage, whereby type of catalyst and process conditions are determined by the type of treatment envisaged.

In British Patent Specification No. 1,546,504, for instance, an acidic second stage catalyst is disclosed containing one or more Group VI metal components and one or more non-noble Group VIII metal components, whereby second stage process conditions are relatively severe and include a temperature of between 350 and 390° C. and a pressure of between 50 and 250 kg/cm$^2$. Operating the second stage under these conditions is likely to cause a substantial degree of aromatics hydrogenation, but also, given the acidic nature of the catalyst employed, a substantial amount of cracking reactions to occur. This inevitably affects the final oil yield due to the formation of a relatively high amount of gaseous components. It would therefore be advantageous if the second stage could be operated at less severe conditions.

U.S. Pat. No. 3,494,854 discloses a second stage hydroisomerization-hydrocracking catalyst comprising a calcium-exchanged, crystalline aluminosilicate (i.e. zeolite) support and a platinum group metal component. Here, the second stage is operated at more severe conditions than the first stage and these second stage operating conditions include temperatures of from about 455° C. to 540° C. and pressures of from about 20 to 140 bar. In the first stage nitrogen level and anyhow sulphur level of the feed are brought down in order not to poison too quickly the second stage catalyst, which normally is not sulphur-resistant. Some hydrocracking may already take place in the first stage, but mostly non-waxy molecules are cracked, since the pour point of the feed does not decrease substantially in the first stage as can be clearly seen from Example 1 of said specification. In the second stage further decrease of the nitrogen level and hydroisomerization and hydrocracking of waxy molecules should take place in order to lower the pour point. However, operating the second stage at such severe conditions will inevitably lead to formation of gaseous components, which goes at the expense of the yield of the final base oil product. Moreover, if too much hydrocracking of waxy molecules occurs, the viscosity index of the final oil will be seriously affected. It would, therefore, be advantageous, if the second stage could be operated at less severe conditions.

In U.S. Pat. No. 3,974,060 a second stage catalyst is disclosed comprising a faujasite support and a noble metal hydrogenation component. The second stage is disclosed to be operated at less severe temperature conditions than the first stage, that is, at a temperature between about 230 and 340° C., and at a pressure of from about 105 to 345 bar in order to limit the amount of cracking that may occur. Conversion of aromatics into polynaphthenics is envisaged to be maximized in the first stage. In the second stage, conversion of polynaphthenics into single ring naphthenes and hydroisomerization of normal paraffins into branched structures are the processes envisaged. Between both stages a gas-liquid separation step may be included to remove any by-product ammonia, hydrogen sulphide and/or light hydrocarbons present in the first stage effluent. A subsequent solvent dewaxing step is considered to be necessary to arrive at a pour point which is appropriate for lubricating base oils.

In European Patent Specification No. 321,298 a hydroisomerization catalyst comprising a noble metal component on a halogenated refractory oxide support is disclosed as the second stage catalyst in a wax isomerization process. Isomerization conditions here include temperatures of from 280 to 400° C. and hydrogen pressures from about 35 to 205 bar. The process disclosed aims at converting slack waxes by isomerizing a substantial portion of the waxy molecules present therein. As the slack waxes by definition have a very high wax content, the viscosity index of the isomerate is very high, usually above 140. After isomerization, the isomerate is fractionated and the lube oil fraction (usually the 330° C.+ fraction and more suitably the 370° C.+ fraction) is subsequently subjected to a dewaxing treatment to attain the required pour point reduction.

Although the processes described above may perform satisfactorily in many respects, it was felt that there is still room for a further improvement, particularly in terms of obtaining lubricating base oils of constant and high quality by means of an efficient and reliable process starting from a distillate feedstock. The present invention provides such a process as can be evidently seen from its advantageous characteristics.

For instance, one advantage of the process according to the present invention is that it yields lubricating base oils of constant and high quality with a high degree of flexibility as to the exact base oil product to be produced. With the present process, namely, it is possible to prepare motor oils, industrial oils and even technical white oils, which base oils predominantly differ from each other in that they have different specifications for contents of aromatics. Another advantage of the present process is that hydrocarbon feedstocks containing relatively high amounts of impurities, such as sulphur- and nitrogen-containing compounds, can be effectively treated and converted into high quality lubricating base oils having excellent VI properties. Yet another advantage is that a very effective use is made of the hydrogen required in the hydrocatalytic conversion stages.

DESCRIPTION OF THE INVENTION

Accordingly, the present invention relates to a process for the preparation of lubricating base oils comprising the steps of (a) contacting a hydrocarbon oil feed in the presence of hydrogen in a first reaction zone with a catalyst comprising at least one Group VIB metal component and at least one non-noble Group VIII metal component supported on a refractory oxide carrier;

(b) separating the effluent at elevated pressure into a gaseous fraction and a liquid fraction having a sulphur content of less than 1000 parts per million on a weight basis (ppmw) and a nitrogen content of less than 50 ppmw;

(c) contacting the liquid fraction in the presence of hydrogen in a second reaction zone with at least a catalyst comprising a noble metal component supported on an amorphous refractory oxide carrier; and (d) recovering a lubricating base oil having a viscosity index of at least 80.

Suitable hydrocarbon oil feeds to be employed in step (a) of the process according to the present invention are mixtures of high-boiling hydrocarbons, such as, for instance, heavy oil fractions. Particularly those heavy oil fractions having a boiling range which is at least partly above the boiling range of lubricating base oils are suitable as hydrocarbon oil feeds for the purpose of the present invention. It has been found particularly suitable to use vacuum distillate fractions derived from an atmospheric residue, i.e. distillate fractions obtained by vacuum distillation of a residual fraction which in return is obtained by atmospheric distillation of a crude oil, as the feed. The boiling range of such a vacuum distillate fraction is usually between 300 and 620° C., suitably between 350 and 580° C. However, deasphalted residual oil fractions, including both deasphalted atmospheric residues and deasphalted vacuum residues, may also be applied. The hydrocarbon feeds to be applied may contain substantial amounts of sulphur- and nitrogen-containing contaminants. Hydrocarbon feeds having sulphur levels up to 3% by weight and nitrogen levels up to 1% by weight may be treated in the process according to the present invention.

The catalyst to be used in the first hydrocatalytic stage is a catalyst comprising at least one Group VIB metal component and at least one non-noble Group VIII metal component supported on a refractory oxide carrier. Such catalysts are known in the art and in principle any hydrotreating catalyst known to be active in the hydrodesulphurization and hydrodenitrogenation of the relevant hydrocarbon feeds may be used. Suitable catalysts, then, include those catalysts comprising as the non-noble Group VIII metal component one or more of nickel (Ni) and cobalt (Co) in an amount of from 1 to 25 percent by weight (%wt), preferably 2 to 15% wt, calculated as element relative to total weight of catalyst and as the Group VIB metal component one or more of molybdenum (Mo) and tungsten (W) in an amount of from 5 to 30% wt, preferably 10 to 25% wt, calculated as element relative to total weight of catalyst. These metal components may be present in elemental, oxidic and/or sulphidic form and are supported on a refractory oxide carrier. The refractory oxide support of the first stage catalyst may be any inorganic oxide, alumino-silicate or combination of these, optionally in combination with an inert binder material. Examples of suitable refractory oxides include inorganic oxides, such as alumina, silica, titania, zirconia, boria, silica-alumina, fluorided alumina, fluorided silica-alumina and mixtures of two or more of these. In a preferred embodiment an acidic carrier such as alumina, silica-alumina or fluorided alumina is used as the refractory oxide carrier. The refractory oxide support may also be an aluminosilicate. Both synthetic and naturally occurring aluminosilicates may be used. Examples are natural or dealuminated zeolite beta, faujasite and zeolite Y. From a selectivity point of view it is preferred to use the dealuminated form of these zeolites. A preferred aluminosilicate to be applied is alumina-bound, at least partially dealuminated, zeolite Y.

Phosphorus (P), which is a well known promoter, may also be present in the first stage catalyst. Examples of particularly suitable first stage catalysts are NiMo(P) on alumina or fluorided alumina, CoMo(P) on alumina and NiW on fluorided alumina.

Since the hydrocarbon feeds to be converted normally contain sulphur-containing compounds, the first stage catalyst is suitably at least partly sulphided prior to operation in order to increase its sulphur tolerance. It will be understood that the extent of sulphidation depends on the sulphur content of the first stage effluent. Since the hydrocarbon oil feeds used are normally not substantially free of sulphur- and nitrogen-containing compounds, sulphiding of the catalyst prior to operation (normally referred to as presulphiding) in order to attain optimum catalyst activity and in order to ensure that the catalyst is sufficiently tolerant towards the sulphur- and nitrogen-containing compounds present in the feed under the operating conditions is preferred.

Presulphiding of the catalyst can be achieved by methods known in the art, such as for instance those methods disclosed in European patent specifications 181,254; 329,499; 448,435 and 564,317 and International patent specifications WO-93/02793 and WO-94/25157. Presulphiding can be performed either ex situ (the catalyst is sulphided prior to being loaded into the reactor) or in situ (the catalyst is sulphided after having been loaded into the reactor). In general, presulphiding is effected by contacting the unsulphided catalyst with a suitable sulphiding agent, such as hydrogen sulphide, elemental sulphur, a suitable polysulphide, a hydrocarbon oil containing a substantial amount of sulphur-containing compounds or a mixture of two or more of these sulphiding agents. Particularly for the in situ sulphidation a hydrocarbon oil containing a substantial amount of sulphur-containing compounds may suitably be used as the sulphiding agent. Such oil is then contacted with the catalyst at a temperature which is gradually increased from ambient temperature to a temperature of between 150 and 250° C. The catalyst is to be maintained at this temperature for between 10 and 20 hours. Subsequently, the temperature is to be raised gradually to the operating temperature. A particular useful hydrocarbon oil presulphiding agent may be the hydrocarbon oil feed, which usually contains a significant amount of sulphur-containing compounds. In this case the unsulphided catalyst may be contacted with the feed under conditions less severe than the operating conditions, thus causing the catalyst to become sulphide. Typically, the hydrocarbon oil feed should comprise at least 0.5% by weight of sulphur-containing compounds, said weight percentage indicating the amount of elemental sulphur relative to the total amount of feedstock, in order to be useful as a sulphiding agent.

The first reaction zone is operated at relatively severe conditions, which are such that sulphur and nitrogen content of the feed are reduced to sufficiently low values, i.e. sulphur and nitrogen content of the liquid fraction obtained in subsequent step (b) discussed hereinafter-must be less than 1000 ppmw and less than 50 ppmw, respectively. This is important, because a noble metal-based catalyst is used in the second reaction zone (step (c)). As is well known in the art, the sulphur- and nitrogen-resistance of noble metal-based catalysts is normally less than catalyst not comprising any noble metal component, as a result of which such catalysts are more quickly poisoned by sulphur and nitrogen contaminants if no measures are taken to prevent such quick poisoning. It has been found that suitable first stage operating conditions involve a temperature of at least 350° C., preferably from 365 to 500° C. and even more preferably from 375 to 450° C. Operating pressure may range from 10 to 250 bar, but preferably is at least 100 bar. In a particularly advantageous embodiment the operating pressure is in the range of from 110 to 170 bar. The weight hourly space velocity (WHSV) may range from 0.1 to 10 kg of oil per liter of catalyst per hour (kg/l.h) and suitably is in the range from 0.2 to 5 kg/l.h. Under the conditions applied hydrocracking of hydrocarbon molecules present in the hydrocarbon feed may also occur. It will be appreciated that the more severe the operating conditions, the more hydrocracking will occur.

After the first hydrocatalytic stage the effluent is separated at elevated pressure in step (b) into a liquid fraction and a gaseous fraction. As has already been indicated hereinbefore, the sulphur and nitrogen content of the liquid fraction obtained should be less than 1000 ppmw and less than 50 ppmw, respectively. More preferably, sulphur and nitrogen content of the liquid fraction are less than 500 ppmw and less than 30 ppmw, respectively. The gaseous fraction contains any excess hydrogen which has not reacted in the first reaction zone as well as any light by-products formed in the first hydrocatalytic stage, such as ammonia, hydrogen sulphide, possibly some hydrogen fluoride, and light hydrocarbons. The gas-liquid separation may be carried out by any gas-liquid separation means known in the art, such as a high pressure stripper. By removing the gaseous constituents from the first stage effluent, the content of ammonia and hydrogen sulphide in said effluent can be effectively reduced to levels, which are sufficiently low to allow the use of (unsulphided) noble metal-based catalysts in the second stage. In a preferred embodiment of the present process the gaseous fraction obtained in step (b) is treated to remove hydrogen sulphide and ammonia, after which the resulting cleaned gas is recycled to the first reaction zone. This cleaned gas, namely, will have a high content of hydrogen and therefore may be conveniently used as (part of) the hydrogen-source in the first hydrocatalytic stage. It will be understood that this recycling of hydrogen also provides advantages in terms of process economics. Treatment of the gaseous fraction to remove the impurities may be carried out by methods known in the art, such as an absorption treatment with a suitable absorption solvent, such as solvents based on one or more alkanolamines (e.g. mono-ethanolamine, di-ethanol-amine, methyl-di-ethanolamine and di-isopropanolamine).

In the second reaction zone or hydroconversion stage (step (c)) the liquid fraction obtained after the gas-liquid separation in step (b) is contacted in the presence of hydrogen with at least a catalyst comprising a noble metal component supported on an amorphous refractory oxide carrier. In the second reaction zone hydrogenation of aromatics still present should anyhow take place. The hydrogenation of the aromatics is necessary to obtain a lubricating base oil having the desired high viscosity index and is also preferred for environmental considerations. This function of the second reaction zone can be referred to as the hydro-finishing function and will be achieved with the aforesaid noble metal-based catalyst. A further function of the second reaction zone may be the (hydro)dewaxing function. This implies predominantly hydroisomerization of waxy molecules, normally straight-chain or slightly branched paraffinic molecules, in order to eventually obtain a lubricating base oil having the appropriate cold flow properties, in particular an appropriate pour point. This function is achieved by a dedicated hydroisomerization or dewaxing catalyst which may also be present in the second reaction zone. Such hydro-isomerization catalyst normally also comprises a noble metal hydrogenation component. Depending on the exact nature of the catalysts employed, the type of feed processed and the operating conditions applied, both aforementioned functions may be combined into a single reactor comprising a combination of two catalyst beds, one catalyst bed comprising a dedicated hydro-isomerization dewaxing catalyst, the other catalyst bed comprising the aforesaid noble metal-based hydrofinishing catalyst. Alternatively, two separate reactors placed in series may be used, whereby each reactor comprises a catalyst bed dedicated to a specific function. In the absence of a dedicated hydro-isomerization catalyst in the second reaction zone, a solvent dewaxing treatment after the second reaction zone is normally necessary to obtain a lubricating base oil having the desired pour point.

The catalyst used in the second reaction zone (further referred to as "the noble metal-based hydro-finishing catalyst"), accordingly, comprises at least one noble Group VIII metal component supported on an amorphous refractory oxide carrier. Suitable noble Group VIII metal components are platinum and palladium. The noble metal-based hydrofinishing catalyst, accordingly, suitably comprises platinum, palladium or both. The total amount of noble Group VIII metal component(s) present suitably ranges from 0.1 to 10%wt, preferably 0.2 to 5%wt, which weight percentage indicates the amount of metal (calculated as element) relative to total weight of catalyst. In addition to the noble metal component a Group VIB metal component (Cr, Mo or W) may be present in an amount of from 5 to 30%wt, preferably 10 to 25%wt, calculated as element relative to total weight of catalyst. It is, however, preferred that the catalyst comprises platinum and/or palladium only as the catalytically active metal and is essentially free of any other catalytically active metal component. It has been found particular important that the catalyst comprises an amorphous refractory oxide as the carrier material. It will be understood that this excludes any refractory oxides of a zeolitic nature, such as aluminosilicates and silica-aluminophosphates. Examples of suitable amorphous refractory oxides include inorganic oxides, such as alumina, silica, titania, zirconia, boria, silica-alumina, fluorided alumina, fluorided silica-alumina and mixtures of two or more of these. Of these, amorphous silica-alumina is preferred, whereby silica-alumina comprising from 5 to 75%wt of alumina has been found to be particularly preferred. Examples of suitable silica-alumina carriers are disclosed in International patent specification No.WO-94/10263. A particularly preferred catalyst to be used as the noble metal-based hydrofinishing catalyst, consequently, is a catalyst comprising platinum and/or palladium supported on an amorphous silica-alumina carrier.

Operating conditions in the second reaction zone suitably are less severe than in the first reaction zone and consequently the operating temperature suitably does not exceed 350° C. and preferably is in the range of from 150 and 350° C., more preferably from 180 to 320° C. The operating pressure may range from 10 to 250 bar and preferably is in the range of from 20 to 175 bar. The WHSV may range from 0.1 to 10 kg of oil per liter of catalyst per hour (kg/l.h) and suitably is in the range from 0.5 to 6 kg/l.h.

In one embodiment of the present invention the second reaction zone comprises the noble metal-based hydrofinishing catalyst as the single catalyst. In this case a subsequent dewaxing step is normally necessary to eventually obtain a lubricating base oil having the desired low pour point, that is, a pour point of at most −6° C. Dewaxing in this case may be carried out by dewaxing techniques known in the art, such as catalytic dewaxing and solvent dewaxing. For this particular configuration, however, a solvent dewaxing step is preferred. Conventional solvent dewaxing processes involve the use of methylethylketone (MEK), toluene or a mixture thereof as the dewaxing solvent. The most commonly applied solvent dewaxing process is the MEK solvent dewaxing route, wherein MEK is used as the dewaxing solvent, possibly in admixture with toluene. If, however, the first stage effluent—and consequently the liquid fraction obtained therefrom in step (b) of the present process—has a sufficiently low content of waxy molecules a subsequent (solvent) dewaxing step may be dispensed with, as in that case the hydroisomerization of waxy molecules catalysed by the noble metal hydrofinishing catalyst under the relatively mild conditions applied is sufficient for obtaining the desired pour point.

In another embodiment of the present invention, the second reaction zone comprises two separate catalyst beds in a single reactor, whereby the upper catalyst bed comprises a noble metal-based catalyst selective for hydroisomerizing and/or hydrocracking of waxy molecules and the lower catalyst bed comprises the noble metal-based hydrofinishing catalyst. In this configuration the two catalyst beds are most suitably arranged in a stacked bed mode.

The noble metal-based catalyst constituting the upper bed should, accordingly, be a dedicated dewaxing catalyst. Such dewaxing catalysts are known in the art usually are based on an intermediate pore size zeolitic material comprising at least one noble Group VIII metal component, preferably Pt and/or Pd. Suitable zeolitic materials, then, include ZSM-5, ZSM-22, ZSM-23, ZSM-35, SSZ-32, ferrierite, zeolite beta, mordenite and silica-aluminophosphates, such as SAPO-11 and SAPO-31. Examples of suitable dewaxing catalysts are, for instance, described in International Patent Specification WO 92/01657, whilst suitable zeolitic carrier materials are, for instance, described in U.S. Pat. Nos. 3,700,585; 3,894,938; 4,222,855; 4,229,282; 4,247,388 and 4,975,177. Another class of useful dewaxing catalysts comprises at least one noble Group VIII metal component supported on a surface deactivated aluminosilicate, such as disclosed in European patent specification No. 96921992.2.

In yet another embodiment of the present invention the second reaction zone comprises a single reactor containing two separate reactor zones, which are separated by a quench in such a way that the temperature in the upper reactor zone containing a catalyst bed which comprises a noble metal-based catalyst selective for hydroisomerizing and/or hydrocracking of waxy molecules, is higher than in the lower reactor zone containing a catalyst bed which comprises the noble metal-based hydrofinishing catalyst. The catalyst in the upper reactor zone is a dedicated dewaxing catalyst as described in the previous paragraph. In this configuration the temperature in the upper reactor zone suitably is in the range of from 250 to 350° C. and the temperature in the lower reactor zone suitably is in the range of from 200 to 300° C. with the proviso that it is lower than the temperature in the upper reactor zone. Operating pressure and WHSV in both reactor zones are within the same limits as described above for the second reaction zone.

In a still further embodiment of the present invention the second reaction zone consists of two separate reactors arranged in a series flow mode, whereby the first reactor contains a catalyst bed comprising a noble metal-based catalyst selective for hydroisomerizing and/or hydrocracking of waxy molecules (i.e. a dewaxing catalyst) and the second reactor contains the noble metal-based hydrofinishing catalyst. The catalyst in the first reactor is a dedicated dewaxing catalyst as described above. This configuration is particularly preferred when the temperature of the last reactor (the hydrofinishing reactor) has to be varied periodically, for example to prepare base oils which are subject to distinct specifications in terms of aromatics content (e.g. motor oils, aromatics-free industrial oils, technical white oils). Operating conditions are the same as described above for the second reaction zone, but in respect of the operating temperature it is preferred to apply a higher temperature in the first reactor than in the second reactor within the limits given. Accordingly, the temperature in the first reactor suitably is in the range of from 250 to 350° C. and the temperature in the second reactor suitably is in the range of from 200 to 300° C.

All configurations, in which the second reaction zone can be operated, involve the presence of hydrogen throughout the entire operation. A hydrogen-containing gas, accordingly, is supplied to the second reaction zone. This may be recycled, cleaned gas obtained from the gaseous fraction recovered in step (b) and/or step (d) of the present process or from another source, which may be the case if the present process is integrated in a refinery including other hydroconversion operations. Alternatively, fresh hydrogen may be supplied to this second reaction zone. Of course, it is also possible to use a mixture of fresh and recycled, cleaned hydrogen. For the purpose of the present invention it has been found particularly advantageous to supply the second reaction zone at least partly with fresh hydrogen.

In step (d), finally, a lubricating base oil having a viscosity index of at least 80, preferably from 80 to 140 and more preferably from 90 to 130, is recovered. Such recovery suitably involves fractionation of the effluent from the second reaction zone (step (c)) to obtain a gaseous fraction and at least one liquid fraction as the lubricating base oil product. Fractionation can be attained by conventional methods, such as by distillation of the effluent from the second reaction zone under atmospheric or reduced pressure. Of these, distillation under reduced pressure, including vacuum flashing and vacuum distillation, is most suitably applied. The cutpoint(s) of the distillate fraction(s) is/are selected such that each product distillate recovered has the desired viscosity, viscosity index and pour point for its envisaged application. A lubricating base oil having a viscosity index of at least 80 is normally obtained at a cutpoint of at least 330° C., suitably at a cutpoint of from 350 to 450° C. and is recovered as the most heavy fraction.

The gaseous fraction obtained in step (d) contains the excess of hydrogen, which has not reacted in the second reaction zone, together with any ammonia and hydrogen sulphide formed in the second reaction zone or already present in the hydrogen-containing gas supplied thereto. Any light hydrocarbons formed in the second reaction zone are also present in this gaseous fraction. For a further optimisation of the process economics it is preferred that the gaseous fraction recovered from step (d) is treated to remove impurities (that is, hydrogen sulphide and ammonia), after which the cleaned gas is recycled to the first and/or the second reaction zone. It has been found particularly advantageous to recycle the hydrogen—after cleaning—to the first reaction zone only. Consequently, the second reaction zone is then supplied with fresh hydrogen only, whilst the first reaction zone is supplied with recycled, cleaned gas from both first and second reaction zone. Treatment of the gaseous fractions from steps (b) and (d) may take place in separate gas cleaning units, but most suitably both gaseous streams, suitably combined into a single gas stream, are treated in one and the same gas cleaning unit. In this way only a single gas cleaning unit is necessary, which is advantageous from an economic perspective.

BRIEF DESCRIPTION OF THE DRAWINGS

Two of the embodiments described above are illustrated by FIGS. 1 and 2.

DETAILED DESCRIPTION OF THE DRAWINGS

Figure 1:
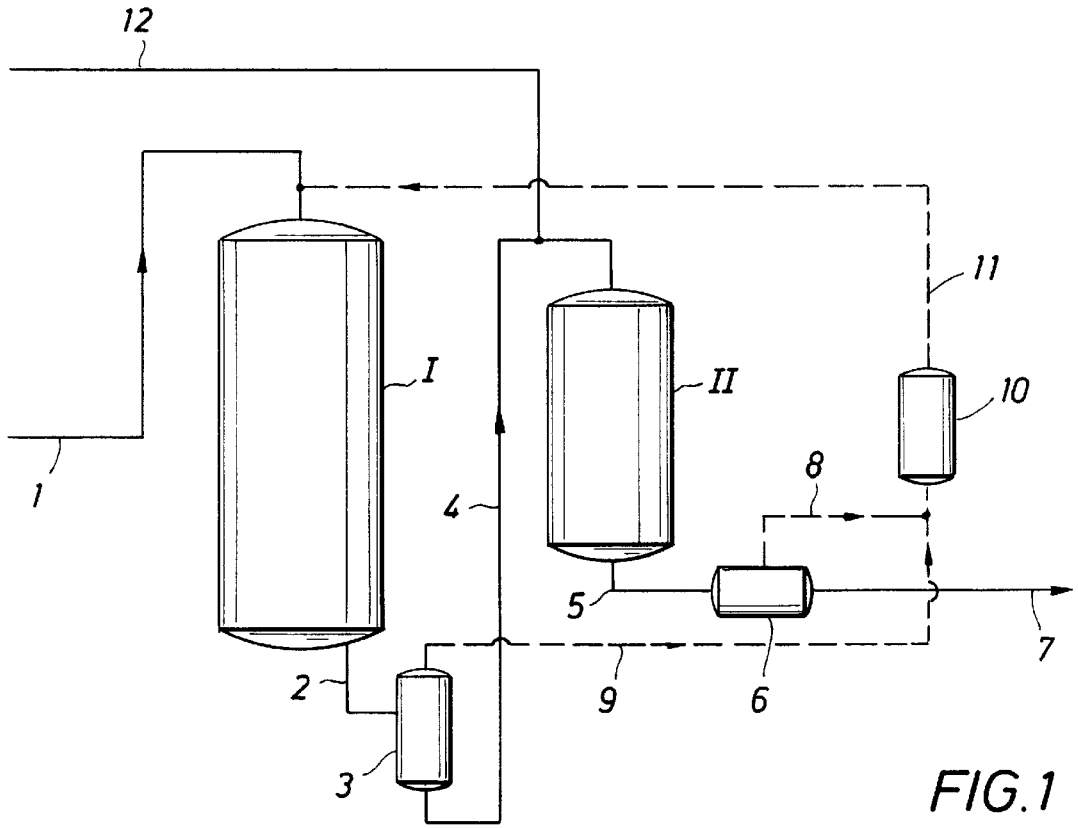
FIG. 1 schematically shows that embodiment of the present process wherein the second reaction zone consists of a single reactor containing the noble metal-based hydrofinishing catalyst only.

In FIG. 1 hydrocarbon oil feed (1) is passed into first reaction zone (I) in the presence of hydrogen supplied via hydrogen stream (11), where it is contacted with the first stage catalyst. The first stage effluent (2) having a sulphur content of less than 1000 ppm and a nitrogen content of less than 50 ppm is separated into a gaseous stream (9) and a liquid stream (4) in high pressure stripper (3). The gaseous stream (9) comprising gaseous sulphur- and nitrogen-containing species as well as hydrogen is cleaned in absorption unit (10) together with the gaseous fraction (8) obtained from gas/liquid separator (6), resulting in a purified hydrogen stream (11) which is used as the hydrogen source for the hydroconversion of hydrocarbon oil feed (1). The liquid stream (4) is subsequently passed into the second reaction zone (II) where it is hydrofinished by contacting it with the noble metal-based hydrofinishing catalyst in the presence of fresh hydrogen supplied via fresh hydrogen stream (12). The second zone effluent (5) is separated into a liquid stream (7) and a gaseous fraction (8) in gas/liquid separator (6). The liquid stream (7), which has a VI of at least 80, is suitably routed to a solvent dewaxing unit (not shown) in order to obtain a lubricating base oil having the desired low pour point.

Figure 2:
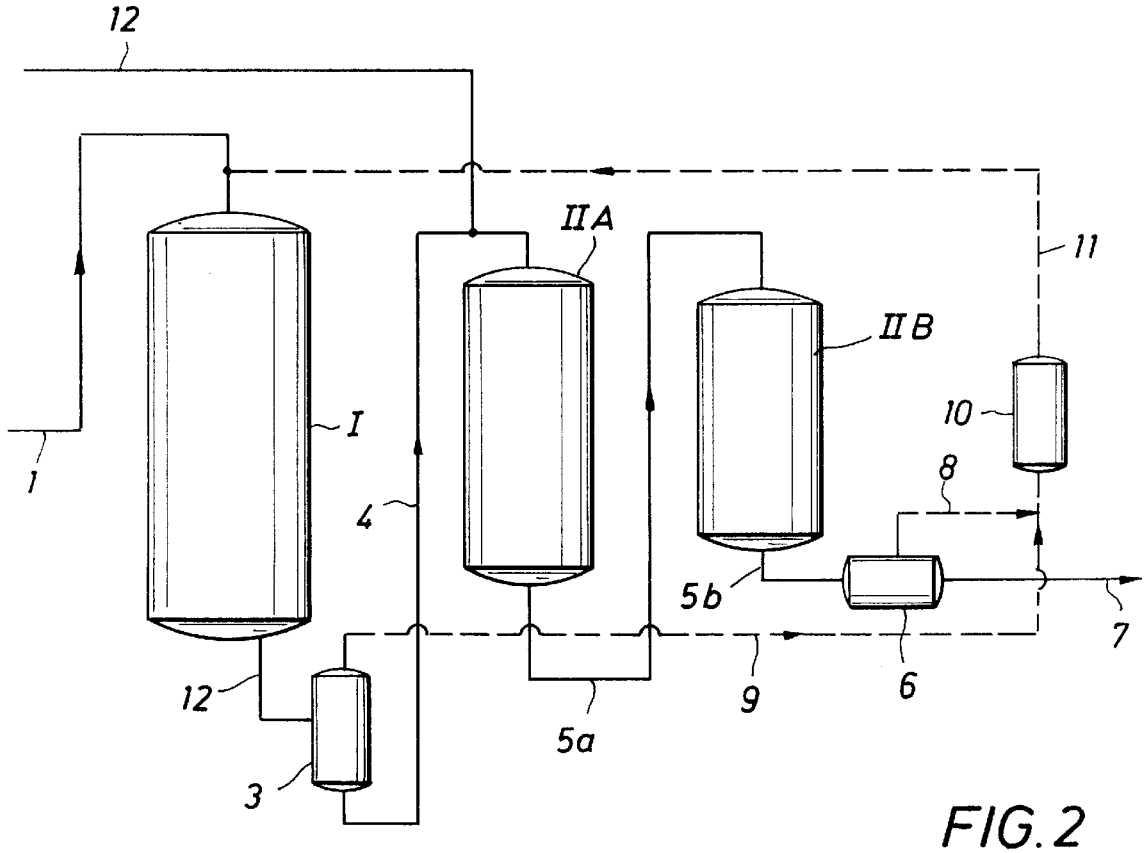
FIG. 2 depicts the embodiment wherein the second reaction zone consists of two separate reactors, one containing a dedicated dewaxing catalyst and the other containing the noble metal-based hydrofinishing catalyst.

FIG. 2 depicts a similar process, wherein the second reaction zone consists of a catalytic dewaxing unit (IIA) and a hydrofinishing unit (IIB). The dewaxed effluent **(5*a*) leaving catalytic dewaxing unit (IIA) is subsequently led into hydrofinishing unit (IIB). The effluent stream (5*b*) leaving the hydrofinishing unit (IIB) is separated into a liquid stream (7) and a gaseous fraction (8) in gas/liquid separator (6). Liquid stream (7)** is the lubricating base oil product.

The invention is further illustrated by the following examples without restricting the scope of the present invention to these particular embodiments.

EXAMPLES

Example 1

A hydrocarbon distillate fraction having the characteristics listed in Table I was treated in the process illustrated in FIG. 1.

TABLE I

| Feed Characteristics | | | |
|---|---|---|---|
| Distillate | | Dewaxed oil[1] | |
| wax (% w) | 7.1 | Aromatics (mmole/100 g) | |
| S (% w) | 2.17 | Mono | 58 |
| N (mg/kg) | 1100 | Di | 24 |
| Boiling point distribution | | Poly | 49 |
| 5% w | 418° C. | | |
| 50% w | 490° C. | | |
| 95% w | 564° C. | | |

[1]A sample of the distillate feed was dewaxed (using methylethylketone at −20° C.) before determining the aromatics content: aromatics determination was carried out at 40° C., at which temperature most of the wax present in the distillate feed is solid and hinders the determination of the various levels of aromatics.

Accordingly, the distillate fraction was contacted in the first reaction zone in the presence of hydrogen with a catalyst comprising 3.0% by weight of Ni, 13.0% by weight of Mo, 3.2% by weight of P on an alumina support, which catalyst was fluorided to contain 2.5% by weight of fluorine. The hydrogen supplied was cleaned hydrogen recovered from the gaseous fraction obtained from the second stage effluent and from the gaseous fraction obtained from the gas/liquid separation of the first stage effluent. Operating conditions in the first reaction zone included a hydrogen partial pressure of 140 bar, a WHSV of 0.5 kg/l/h, a recycle gas rate of 1500 Nl/kg and a temperature of 378° C.

The first stage effluent was then separated into a liquid and a gaseous fraction in a high pressure separator. Sulphur content of the liquid fraction was 48 ppmw, nitrogen content was 3 ppmw.

The liquid fraction was subsequently treated in the second reaction zone in the presence of freshly supplied hydrogen over a catalyst comprising 0.3% by weight of Pt and 1.0% by weight of Pd on an amorphous silica-alumina carrier having a silica/alumina weight ratio of 55/45. Hydrogen partial pressure and recycle gas rate were the same as applied in the first reaction zone. Varying temperatures and space velocities were, however, applied in order to obtain different products. These temperatures and space velocities are indicated in Table II.

The second stage effluent was, after gas/liquid separation, distilled under reduced pressure and the fraction boiling above 390° C. was solvent dewaxed at a temperature of −20° C. using methylethylketone/toluene. Properties of the various base oil products are indicated in Table II.

As can be seen from Table II varying temperatures and space velocities in the second reaction zone can result in different products, mainly in terms of aromatics content. In this way products can be obtained meeting the aromatics specifications of motor oils (MO), industrial oils (IO) and technical white oils (TWO).

TABLE II

| Product Analysis | | | |
|---|---|---|---|
| Product | MO | IO | TWO |
| T (° C.) | 230 | 270 | 250 |
| WHSV (kg/l.h) | 4 | 4 | 1 |
| S (ppmw) | 42 | | 42 |
| N (ppmw) | 2.5 | | 2.2 |

TABLE II-continued

| Product Analysis | | | |
|---|---|---|---|
| Product | MO | IO | TWO |
| VI | 95.7 | 95.7 | 95.3 |
| Pour Point (° C.) | −15 | −15 | −15 |
| Oil yield (% w on feed) | 65.2 | 65.3 | 64.4 |
| Aromatics (mmol/100 g) | | | |
| Mono | 34 | 5.5 | 1.6 |
| Di | 0.53 | 0.72 | 0.11 |
| Poly | 0.61 | 0.41 | 0.04 |

Example 2

A distillate fraction having the characteristics as indicated in Table I was treated in accordance with the process illustrated in FIG. 2.

Accordingly, the distillate fraction was contacted in the first reaction zone in the presence of hydrogen with the same first stage catalyst as used in Example 1. The hydrogen supplied also was cleaned hydrogen recovered from the gaseous fraction obtained from the second reaction zone effluent and from the gaseous fraction obtained from the gas/liquid separation of the first reaction zone effluent. Operating conditions in the first reaction zone included a hydrogen partial pressure of 140 bar, a WHSV of 1.0 kg/l/h, a recycle gas rate of 1500 Nl/kg and a temperature of 390° C.

The first stage effluent was then separated into a liquid and a gaseous fraction in a high pressure separator. Sulphur content of the liquid fraction was 45 ppmw, nitrogen content was less than 1 ppmw.

The liquid fraction was subsequently treated in the second reaction zone consisting of two separate reactors (IIA) and (IIB). In the first reactor (IIA) the liquid fraction was contacted in the presence of freshly supplied hydrogen with a bed of dewaxing catalyst comprising 0.8%w platinum supported on a carrier comprising surface dealuminated ZSM-5 having a silica to alumina molar ratio of 51.6 and a silica binder (70%w surface dealuminated ZSM-5 and 30%w silica binder). This type of dewaxing catalyst is disclosed in European patent specification No. 96921992.2. Operating conditions in reactor (IIA) included a hydrogen partial pressure of 40 bar, a WHSV of 1 kg/l.h and a temperature of 310° C.

The effluent from the first reactor (IIA) was then contacted in the second reactor (IIB) with a catalyst comprising 0.3% by weight of Pt and 1.0% by weight of Pd on an amorphous silica-alumina carrier having a silica/alumina weight ratio of 55/45. Operating conditions in this reactor included a hydrogen partial pressure of 140 bar, a WHSV of 4 kg/l.h and a temperature of 290° C. The effluent from the rector (IIB) was, after gas/liquid separation, distilled under reduced pressure and the fraction boiling above 390° C. was recovered as the lubricating base oil product. Its properties are listed in Table III.

TABLE III

| Lubricating Base Oil Properties | | | |
|---|---|---|---|
| VI | 95 | Aromatics (mmole/100 g) | |
| S (ppmw) | <5 | Mono | 8.3 |
| N (ppmw) | <1 | Di | 0.30 |
| Pour point (° C.) | −9.5 | Poly | 0.40 |
| Oil yield (% w) | 62 | | |

From Table III it can be seen that a good quality lubricating base oil is obtained having low sulphur, nitrogen and aromatics content at a commercially acceptable yield.

I claim:

1. A process for the preparation of lubricating oils comprising the steps of:

a) contacting a hydrocarbon oil feed in the presence of hydrogen in a first reaction zone with a catalyst comprising at least one Group VIB metal component and at least one non-noble Group VIII metal component supported on a refractory inorganic oxide carrier incorporating fluorinated alumina and dealuminated zeolites at conditions in said first reaction zone effective to produce a liquid fraction having a sulfur content of less than 1000 ppmw and a nitrogen content of less than 50 ppmw;

b) separating the effluent at elevated pressure into a gaseous fraction and a liquid fraction having said sulfur content of less than 1000 ppmw and said nitrogen content of less than 50 ppmw;

c) contacting the liquid fraction in the presence of hydrogen in a second reaction zone with at least a catalyst comprising a noble metal component supported on an amorphous refractory oxide carrier; and d) recovering lubricating base oil having a viscosity index of at least 80.

2. The process according to claim 1, wherein the first reaction zone is operated at a temperature of at least 350° C.

3. The process according to claim 1, wherein the gaseous fraction obtained in step (b) is treated to remove hydrogen sulphide and ammonia, after which the resulting cleaned gas is recycled to the first reaction zone.

4. The process according to claim 1, wherein the second reaction zone is operated at a temperature of at most 350° C.

5. The process according to claim 1, wherein the second reaction zone comprises a catalyst comprising at least one noble Group VIII metal component supported on an amorphous refractory oxide carrier as the single catalyst.

6. The process according to claim 1, wherein the second reaction zone comprises two separate catalyst beds, whereby the upper catalyst bed comprises a noble metal-based catalyst selective for hydroisomeri-sing and/or hydrocracking of waxy molecules and the lower catalyst bed comprises the catalyst comprising at least one noble Group VIII metal component supported on an amorphous refractory oxide carrier.

7. The process according to claim 6, wherein the two catalyst beds are arranged in a stacked bed mode.

8. The process according to claim 1, wherein the second reaction zone comprises a single reactor containing two separate reactor zones, which are separated by a quench in such a way that the temperature in the upper reactor zone containing a catalyst bed which comprises a noble metal-based catalyst selective for hydroisomerizing and/or hydrocracking of waxy molecules, is higher than in the lower reaction zone containing a catalyst bed which comprises the catalyst comprising at least one noble Group VIII metal component supported on an amorphous refractory oxide carrier.

9. The process according to claim 8, wherein the temperature in the upper reactor zone is in the range of from 250 to 350° C. and the temperature in the lower reactor zone is in the range of from 150 to 250° C.

10. The process according to claim 1, wherein the second reaction zone consists of two separate reactors arranged in a series flow mode, whereby the first reactor contains a catalyst bed comprising a noble metal-based catalyst selective for hydroisomerizing and/or hydrocracking of waxy molecules and the second reactor contains a catalyst bed comprising the catalyst comprising at least one noble Group VIII metal component supported on an amorphous refractory oxide carrier.

11. The process according to claim 1, wherein the catalyst comprising at least one noble Group VIII metal component supported on an amorphous refractory oxide carrier is a catalyst comprising platinum and/or palladium supported on an amorphous silica-alumina carrier.

12. The process according to claim 6, wherein the noble metal-based catalyst selective for hydroisomerizing and/or hydrocracking of said waxy molecules is a catalyst comprising platinum and/or palladium on a zeolite carrier selected from the group of consisting of the natural or dealuminated forms of zeolite beta, faujasite, and zeolite Y.

13. The process according to claim 1, wherein the second reaction zone is supplied at least partly with fresh hydrogen, optionally containing small amounts of ammonia and/or hydrogen sulphide.

14. The process according to claim 1, wherein step (d) involves fractionation of the effluent from step (c) to obtain a gaseous fraction and at least one liquid fraction as the lubricating base oil product.

15. The process according to claim 14, wherein the gaseous fraction is treated to remove impurities, after which the cleaned gas is recycled to the first and/or the second reaction zone.

* * * * *